United States Patent [19]

Fuhrhop

[11] 4,286,782

[45] Sep. 1, 1981

[54] MULTI-PURPOSE EXERCISE ENHANCING DEVICE

[76] Inventor: Marious P. Fuhrhop, 8007 Greenlawn, Houston, Tex. 77088

[21] Appl. No.: 955,174

[22] Filed: Oct. 26, 1978

[51] Int. Cl.[3] ..... A63B 21/06

[52] U.S. Cl. ..... 272/117; 272/93; 272/123; 272/62; 272/63; 272/145; 272/134

[58] Field of Search ..... 272/116, 117, 123, 122, 272/134, 138, 143, 144, DIG. 4

[56] References Cited

U.S. PATENT DOCUMENTS

| | | | |
|---|---|---|---|
| 2,783,045 | 2/1957 | Bosch | 272/134 X |
| 3,866,914 | 2/1975 | Jackson | 272/117 X |
| 4,153,244 | 5/1979 | Tauber | 272/117 |

*Primary Examiner*—Richard C. Pinkham

*Assistant Examiner*—William R. Browne

*Attorney, Agent, or Firm*—Pravel, Gambrell, Hewitt, Kirk, Kimball & Dodge

[57] ABSTRACT

A multi-purpose exercise enhancing device which is easily assembled and modified for a variety of exercise uses and is easily disassembled for storage and ease of transportation. The multi-purpose exercise enhancing device includes vertical support members releasably connected with base members and horizontal members to form a vertical support assembly and includes a slidably mounted inclined back support panel for performing hackleg exercises. The device further includes an adjustable horizontal member, a plurality of pulley assemblies, a plurality of pull ropes, and weights interchangably connected therewith for performing cable pull-type exercises.

1 Claim, 22 Drawing Figures

MULTI-PURPOSE EXERCISE ENHANCING DEVICE

TECHNICAL FIELD

The field of this invention is portable multi-purpose exercise enhancing devices for assisting a user in performing a multitude of conventional body building and physical fitness exercises which is easily collapsible and readily storable.

BACKGROUND ART

In recent years there has been greater public acceptance of the need for a personal routine physical fitness program. The problem faced by many has been the inaccessibility of physical fitness facilities. One solution to such a problem is to make readily available a portable, multi-function exercise enhancing device for the serious athlete or body builder which is collapsible and stored easily in a small closet, storage room or the like. Such a device is needed that can be used in a confined area such as a house, garage, apartment, or such.

Previous attempts have been made to meet the need for a collapsible, multi-purpose exercise apparatus. One such apparatus is disclosed in U.S. Pat. No. 4,098,502 of Faust; another is taught by U.S. Pat. No. 3,948,513 of Pfotenhauer. Although the apparatus of Pfotenhauer meets the requirement of multiple-function and collapsibility, it is designed to be used in one position for certain exercises and an inverted position for remaining recommended exercises. A relatively large exercise area, therefore, is required.

Another such rectangularly configured collapsible multi-function exercise is disclosed in U.S. Pat. No. 3,501,140 of Eichorn. The exercise load is provided by two methods: (1) tension springs for use in "weight-pull" type exercises and (2) the user's own body weight when used in conventional exercises.

Other portable exercise devices utilizing user-provided load are disclosed by U.S. Pat. Nos. 3,716,231; 3,735,979; 3,857,561; 3,891,207; 3,949,983; and 4,101,124. Exercise apparatuses utilizing spring or friction loads are disclosed in U.S. Pat. Nos. 2,117,957; 3,976,058; and 3,984,101. Exercise devices providing self-contained weight loads or for use with conventional bar bells are disclosed by U.S. Pat. Nos. 3,342,485; 3,708,167; and 3,734,495.

There presently exists a need for a collapsible, multi-function exercise enhancing device which can be used in a house or apartment and be easily stored when not in use. Another requirement of such a device is that a dedicated body builder may perform conventional exercises in the same manner in which he is accustomed or has been trained in his formative years in a professionally oriented health facility. Such a device must be of free-standing design, easily adjustable, lightweight but strong and economical to own.

DISCLOSURE OF THE INVENTION

This invention relates to a new and improved collapsible multi-purpose exercise enhancing device for athletes or others engaged in a comprehensive physical fitness program.

The device of this invention is collapsible and can be assembled in a variety of configurations for performing a multiplicity of individual exercises. The device includes a vertical support portion having two parallel vertical members connected to one another and releasably connected to base members for holding the vertical members in an upright position. The vertical support portion is adapted to receive a multiplicity of accessories enabling the user to perform in excess of twenty different body building and physical fitness exercises. The device of this invention, when assembled, is free standing, negating attachment to solid structures such as floors, walls or door jambs. It is adjustable to individual height, weight, and leg length, and other physical parameters of the user, yet it can be completely collapsed for storage in a small closet, storage room or the like. The device of this invention in its various forms serves as the following exercise enhancing apparatuses known to gymnasiums and health clubs: standing biceps bench, supine bench, incline/decline bench, leg press machine, seated biceps bench, seated calf machine, leg curl machine, thigh extension machine, abdominal board, roman chair situp machine, standing calf machine, hack leg machine, chinning bar, dipping bars, overhead lat pull, horizontal lat pull, lat rowing bar, weight stand, squat rack and cable pull.

BEST MODE FOR CARRYING OUT THE INVENTION

The multi-purpose exercise enhancing device, generally designated by the letter E, of the preferred embodiment of this invention is for use by athletes or others engaged in a comprehensive physical fitness program.

Figure 1:
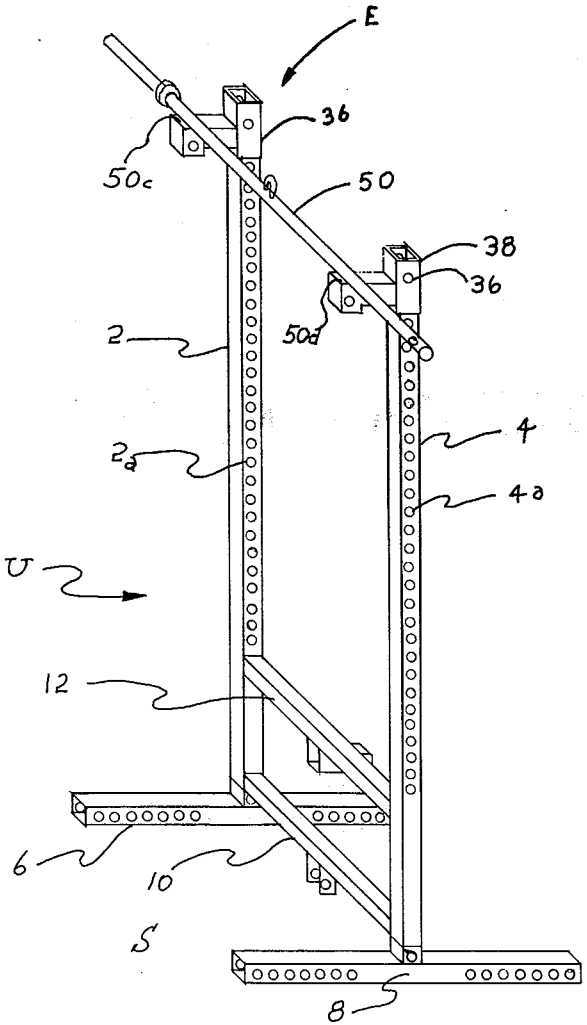
FIG. 1 is a perspective view of the multi-purpose exercise enhancing device assembled for performance of chinning exercises.

As illustrated in FIG. 1, the multi-purpose exercise enhancing device E includes an upright support section, generally designated by the letter U. The upright support section U further includes first and second vertical support members 2 and 4, respectively, which are releasably connected to first and second base members 6 and 8 respectively for holding the vertical support members 2 and 4 in a vertical relationship to the ground, floor or other substantially horizontal support surface S upon which the device E is utilized. Vertical support members 2 and 4 of the upright support section U are held parallel to one another by first and second horizontal members 10 and 12 in order that the section U can provide primary support for each of the embodiments of device E. The releasable attachment of vertical support members 2 and 4 to base members 6 and 8, respectively allow upright support section U to be disassembled for easy transportability and convenient storage in essentially a flat panel-like condition.

Figure 19:
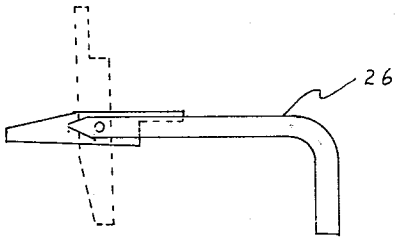
FIG. 19 is a side view of the height adjustment pin.

The support members of section U, like the support members of the remaining embodiments of device E are tubular members, preferably of square cross section, which are lightweight for easy transportability and yet sufficiently strong to support a user and exercise weights he might utilize while exercising. Vertical support members 2 and 4 include a plurality of evenly spaced and aligned openings 2*a* and 4*a*, respectively, which cooperate with the aligned openings of various accessories, discussed later herein, to receive securing pins 26 therein to attach and secure these accessories at a predetermined adjustable height on the section U. All detachable connections, except where herein noted, are made by mounting one tubular member concentrically inside another tubular member in a telescoping fashion for ease of adjustment and enhanced strength. All of these connections are made by inserting a securing pin 26 (FIG. 19) through the aligned openings in the inner and outer telescoped members at the desired adjustment. The securing pins 26 used in the releasable connections in this invention are of the release-lock type as known presently in adjustable weight apparatuses currently used in gymnasiums, health clubs, etc. In view of the foregoing disclosure it is believed that one of ordinary skill in the art will be enabled to assemble, adjust and insert pin 26 without repeating this disclosure for every variation of the multi-purpose device E.

Figure 10:
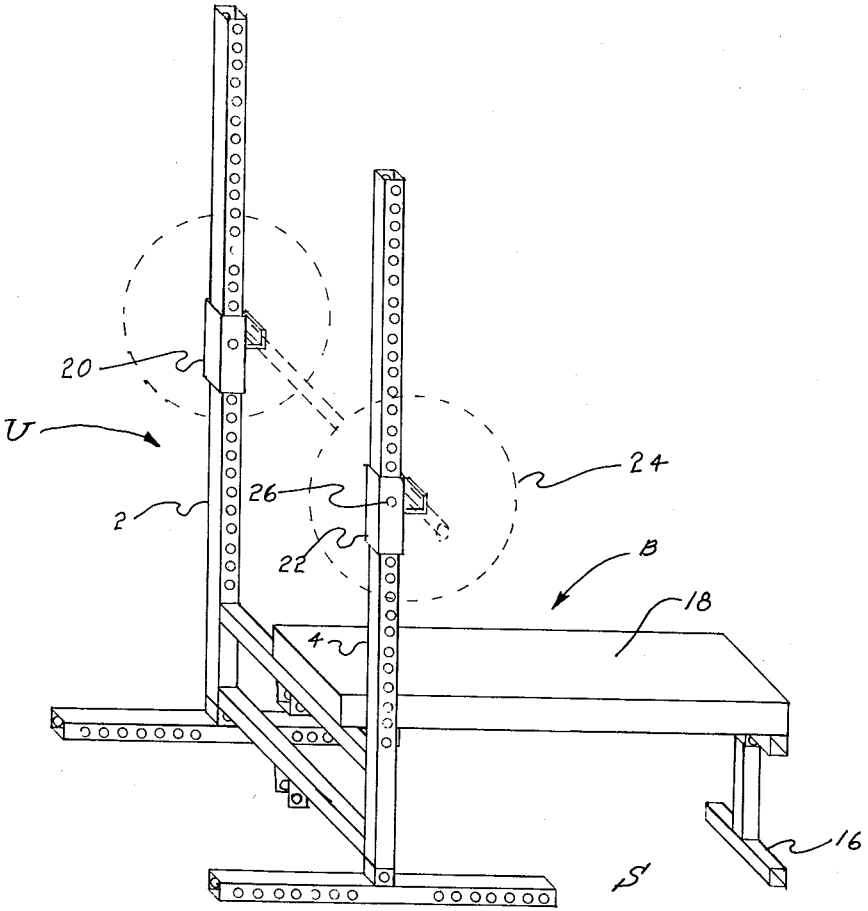
FIG. 10 is a perspective view of the multi-purpose exercise enhancing device assembled for exercises enhanced by supine bench.
Figure 18:
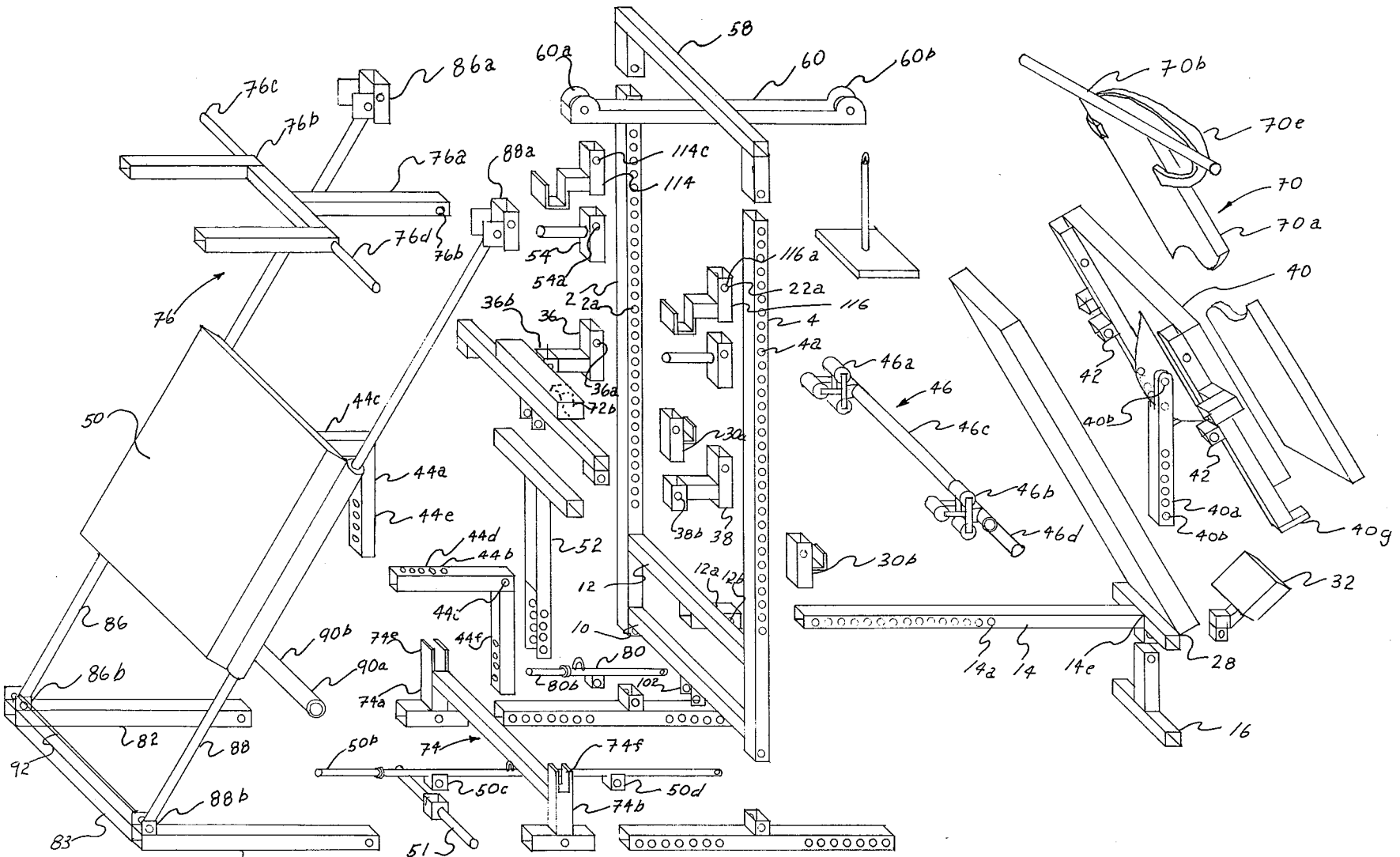
FIG. 18 is an exploded view of the individual components of the multi-purpose exercise enhancing device.

Device E may be assembled, as illustrated in FIG. 10, for the performance of bench-press exercises. A variable inclined bench assembly B which includes a body panel support frame 14 (FIG. 18) is adapted to be partially supported by horizontal member 12 of the upright support section U. A body panel support foot 16 extends downwardly from the support frame 14 at the other end to engage the ground or substantially horizontal surface S. Body panel 18 is mounted horizontally on the body panel support frame 14 to support the back of a user in a horizontal plane while allowing the user's feet to engage the ground. While assembled in this configuration, barbell support means 20 and 22 are slidably and adjustably mounted with vertical support members 2 and 4, respectively, to cooperate in holding a set of barbells 24. The barbell support means 20 and 22 have aligned openings 20*a* and 22*a* which cooperate with aligned openings 2*a* and 4*a* in vertical support members 2 and 4, respectively, to receive securing pins 26 to maintain barbell support means 20 and 22 at a predetermined and adjustable height as previously described. As the user lies in a supine position on body panel 18, the user's legs straddle the body panel 18 as the user bends his knees and his feet engage the floor or support surface S. The user than grasps barbells 24 to remove them from barbell support means 20 and 22 to perform conventional bench press exercises.

Figure 11:
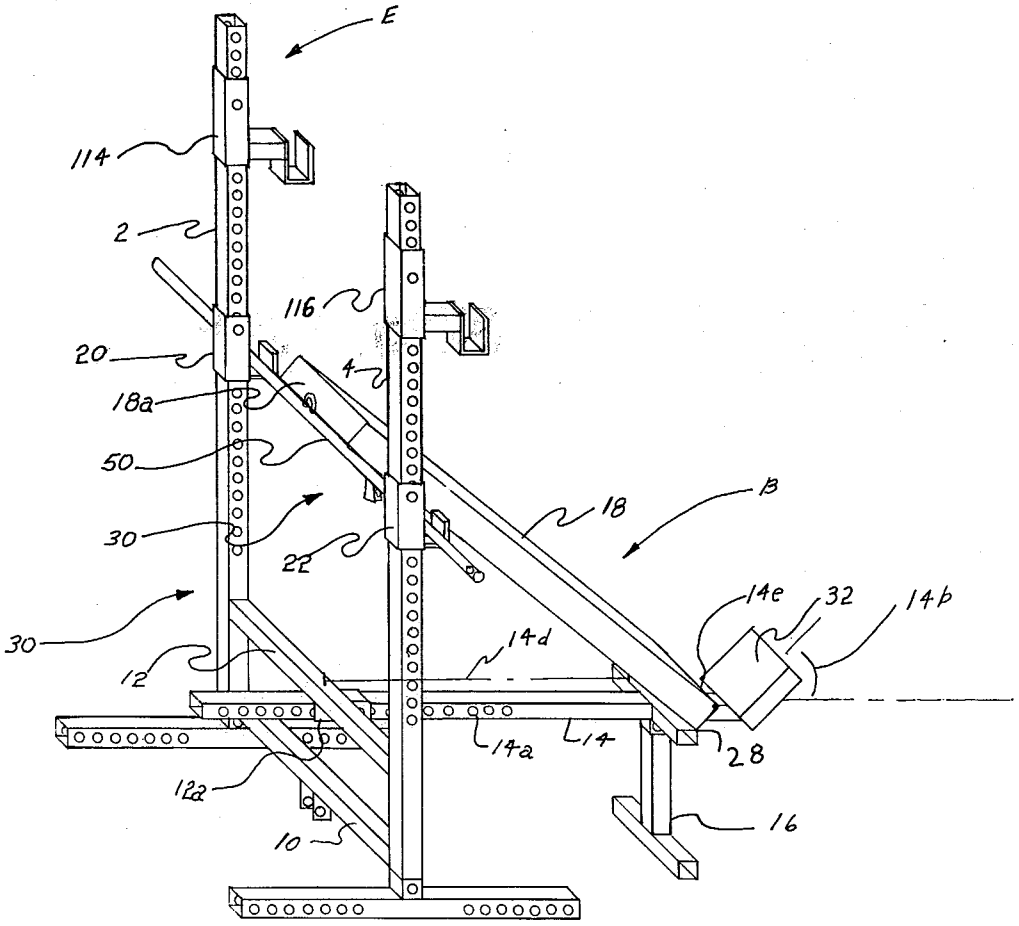
FIG. 11 is a perspective view of the multi-purpose exercise enhancing device assembled for exercises enhanced by incline/decline bench.
Figure 20:
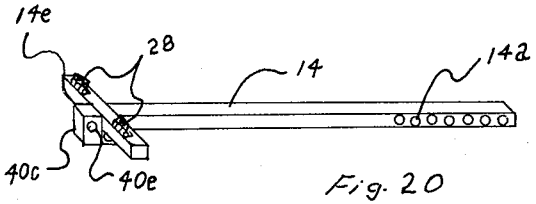
FIG. 20 is a perspective view of the body panel support frame.
Figure 22:
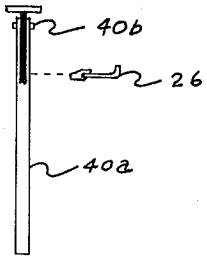
FIG. 22 is an end view of the vertical support member of the user partial rest platform.

Device E may be assembled to enhance the performance of incline or decline bench presses as illustrated by the embodiment in FIG. 11. Body panel 18 is provided with a hinged connection at 28 with support frame 14 (see also FIG. 20) enabling body panel 18 to be raised at one end from the body panel support frame 14 for providing an inclined body support surface for the user. A body panel support means 30 includes a first and second barbell support means 20 and 22 slidably and adjustably mounted on vertical support members 2 and 4, respectively for providing the inclined body support surface. Body panel support means 30 further includes a weight support means 50 which operates in cooperation with barbell support means 20 and 22 to provide a support means 30 adjustable in height for end 18*a* body panel 18. The body panel support frame 14 is slidably and adjustably mounted to second horizontal member 12 by adjustable connection means 12*a*. Body panel support frame 14 has a plurality of evenly spaced aligned openings 14*a* extending laterally therethrough and perpendicular to the longitudinal axis 14*b* that are alignable with openings 12*b* of the connection means 12*a* to receive the securing pin 26, in a manner previously described. The incline of body panel 18 may be adjusted by simultaneously raising body panel support means 30 and reducing the distance 14*d* between horizontal member 12 and support foot 16. The first and second extended barbell support means 114 and 116 are also slidably and adjustably mounted on vertical support members 2 and 4, respectively, and cooperate to hold barbells (not shown) in the preferred position for the user. A seat 32 is releasably connected to body panel support frame 14 at end portion 14*e* with the plane of seat 32 inclined from the longitudinal axis 14*b* of body panel support frame 14 at angle 34. When used as an inclined bench, user sits on seat 32 while resting his back on body panel 18 and resting his feet on the ground or support surface S. The user will grip barbells (not shown) on supports 114 and 116 to perform incline bench presses. The user may also utilize the device E in this configuration to perform decline bench presses by laying on body panel 18 while supporting his head and shoulders on seat 32 while draping his legs over the end 18*a* thereof between vertical support members 2 and 4.

Figure 12:
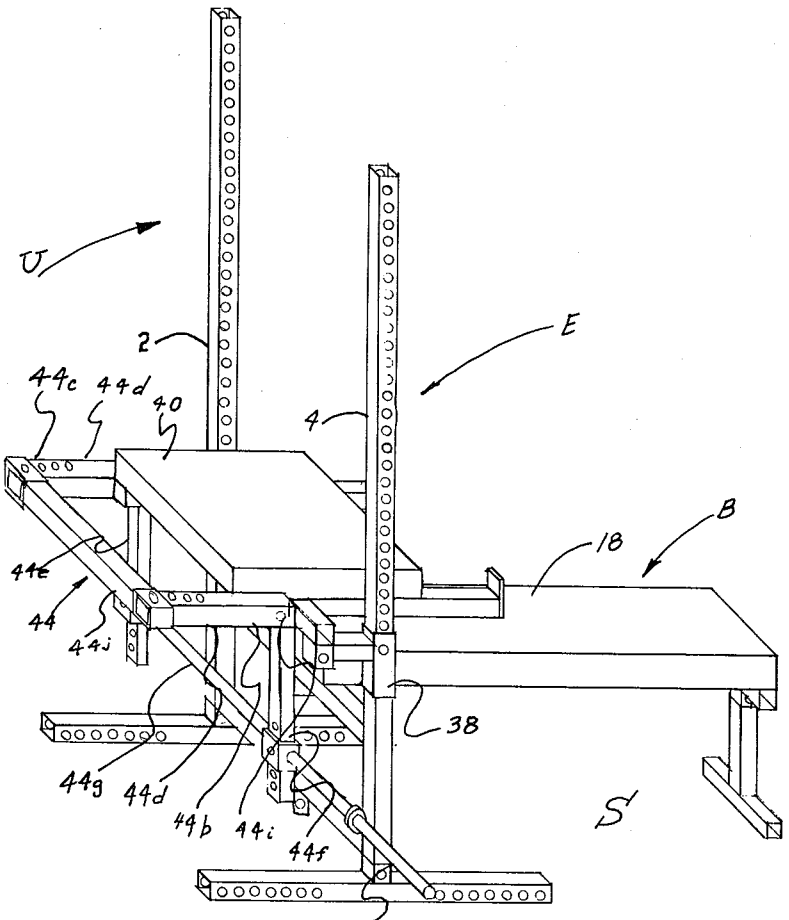
FIG. 12 is a perspective view of the multi-purpose exercise enhancing device assembled for performance of leg curl/thigh extension exercises.

The multi-purpose exercise enhancing device E can be further modified to perform leg curl and thigh extension exercises as illustrated in FIG. 12. The upright support section U is used in combination with bench assembly B previously described. First and second universal connecting means 36 and 38 are slidably and adjustably mounted with vertical support members 2 and 4, respectively, in a manner similar to that previously disclosed for barbell support means 20 and 22 for supporting various accessories used in combination with upright support section U. A user partial rest platform 40 is releasably connected to universal connecting means 36 and 38. A leg exercise means 44 has first and second L-shaped members 44*a* and 44*b* pivotally mounted to the partial rest platform 40 at pivot points 44*i*. The members 44*a* and 44*b* have first and second horizontal members 44*c* and 44*d* connected at right angles to first and second vertical members 44*e* and 44*f*. A lifting means 44*g* connects the ends of first and second vertical members 44*e* and 44*f*. Weight mounting or carrying means 44*h* is an integral part of lifting means 44*g*. The user places a pre-determined magnitude of weights on weight mounting means 44*h* and sits on platform 40 facing away from upright support section U. The user extends his legs downwardly engaging lifting means 44*g* and performs thigh extension exercises by alternately raising the lower portion of his legs to a straightened, horizontal position followed by relaxing his legs so that the lower portion resumes a vertical position.

The device E as just described for performing thigh extension exercises may also be used to perform leg curl exercises when the user lays face down on the multi-purpose exercise enhancing device E causing the front portion of his thighs to be supported by user partial rest platform 40. Upper body portion of the user is supported by the user's arms as his hands engage the sides of body panel 18 thus maintaining the user in a face down prone position. With a predetermined magnitude of weights weight mounting means 44*h*, the user engages the back portion of his lower leg portion to engage upper lifting means 44*j* between members 44*c* and 44*d*. He then alternately raises his legs to a 90° position lifting the weights and relaxes his legs to the horizontal position as he performs leg curl exercises.

Figure 13:
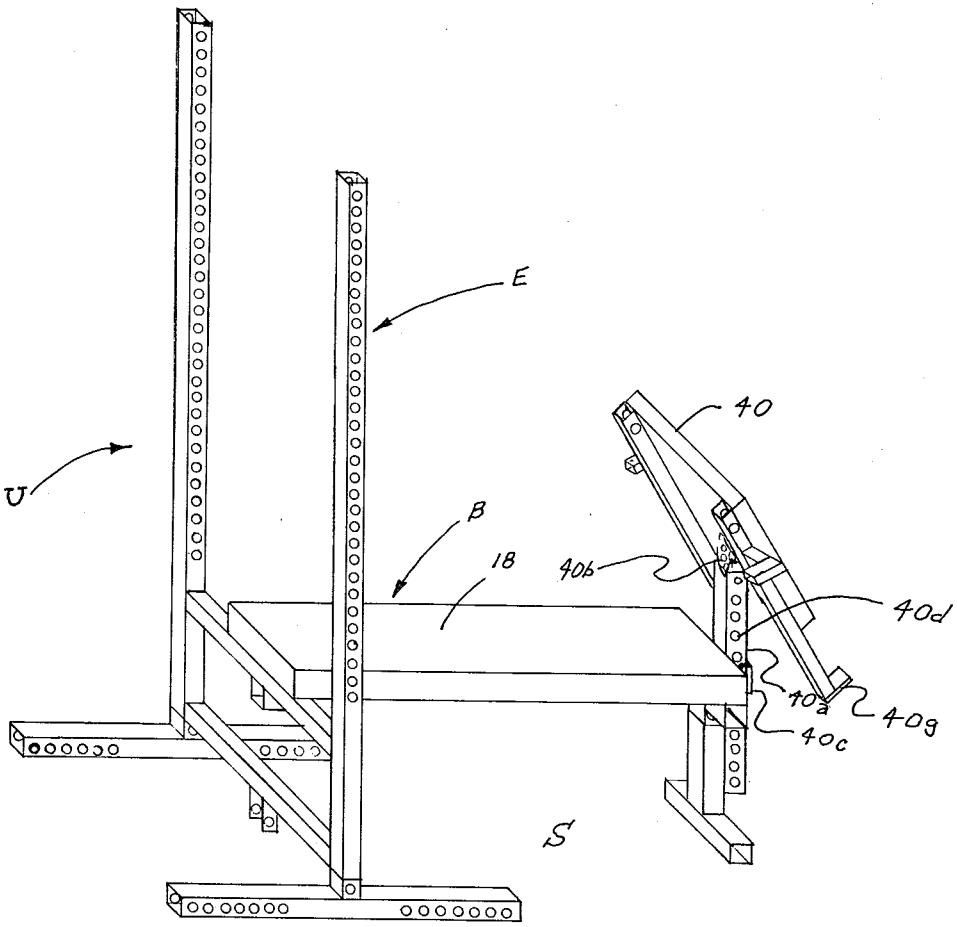
FIG. 13 is a perspective view of the multi-purpose exercise enhancing device assembled for performance of seated biceps exercises.
Figure 21:
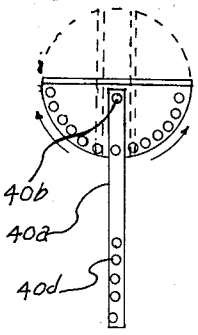
FIG. 21 is a side view of the vertical support member of the user partial rest platform.

Device E can be assembled in yet another embodiment (FIG. 13) for performing seated bicep exercises by using upright support section U, bench assembly B and user partial rest platform 40 having a pair of barbell support means 40*g*. The platform 40 has a vertical support member 40*a* to which it is pivotally mounted at 40*b* (see detail in FIG. 21). The vertical platform support member 40*a* is adjustably mounted to the body panel support frame 14 at 14*e* by bolted on releasable tubular mounting means 40*c*. Vertical member 40*a* has a plurality of evenly spaced aligned openings 40*d* extending laterally therethrough which cooperate with openings 40*e* in tubular mounting means 40*c* to adjust the height of vertical member 40*a* by securing pin 26 through aligned openings 40*d* and 40*e*. The user sits on body panel 18 facing platform 40 while straddling the panel 18 for allowing his feet to engage the ground or support surface S. The platform 40 adjusts at point 40*b* to provide proper angled support for user's biceps. The device E in this embodiment allows user to perform seated curls while resting his triceps on user partial rest platform 40 which may be padded to provide a more comfortable support for user's biceps. Suitable barbell support means 40*g* are provided when the barbells (not shown) are not in use.

Figure 14:
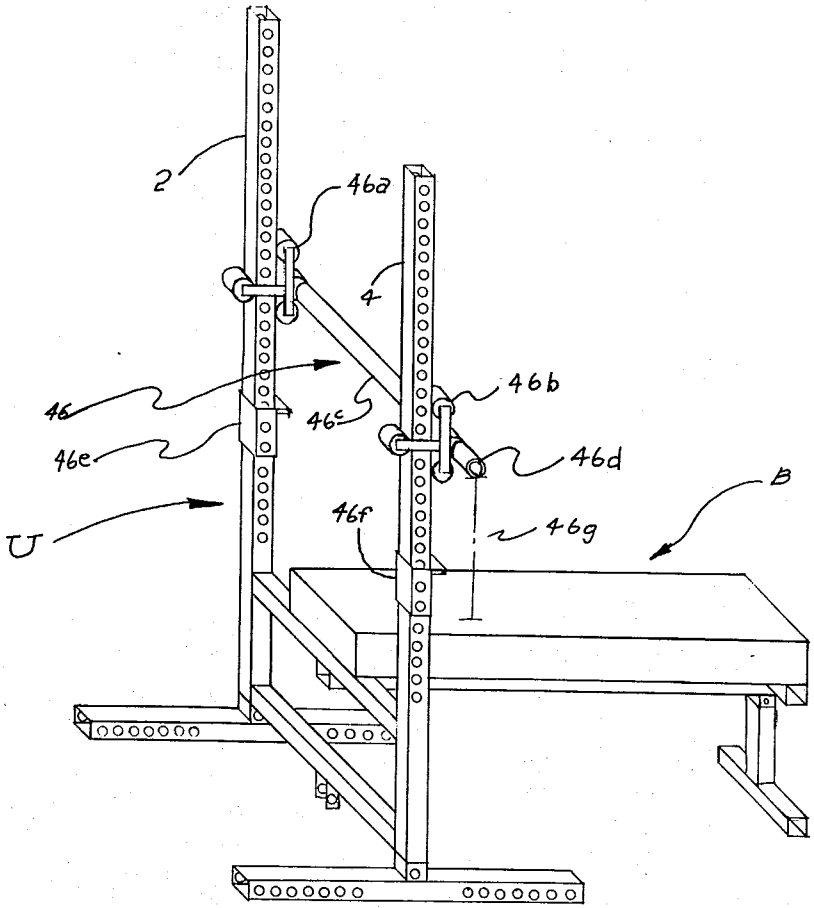
FIG. 14 is a perspective view of the multi-purpose exercise enhancing device assembled for performance of leg press exercises.

The multi-purpose exercise enhancing device E can be assembled for the enhancement of leg press exercises as seen in FIG. 14. This embodiment includes upright support section U and bench assembly B as previously described and further includes leg press assembly 46. Leg press assembly 46 has first and second roller means 46*a* and 46*b* mounted on vertical support members 2 and 4, respectively, and which are connected to leg press means 46*c* having weight attaching means 46*d* for receiving a predetermined magnitude of exercise weight. Roller means 46*a* and 46*b* cooperate with leg press means 46*c* for free reciprocal vertical movement along vertical support members 2 and 4. First and second roller stop means 46*e* and 46*f* are slidably and adjustably mounted with vertical support members 2 and 4, respectively, in a manner similar to barbell support means 20 and 22, previously described, to hold leg press assembly 46 at a predetermined minimum height 46*g* above body panel 18. The user lays on his back on body panel 18 causing the bottoms of his feet to engage leg press means 46*c*, and the user performs leg press exercises by raising and lowering leg press means 46*c* by extending his legs vertically.

Figure 16:
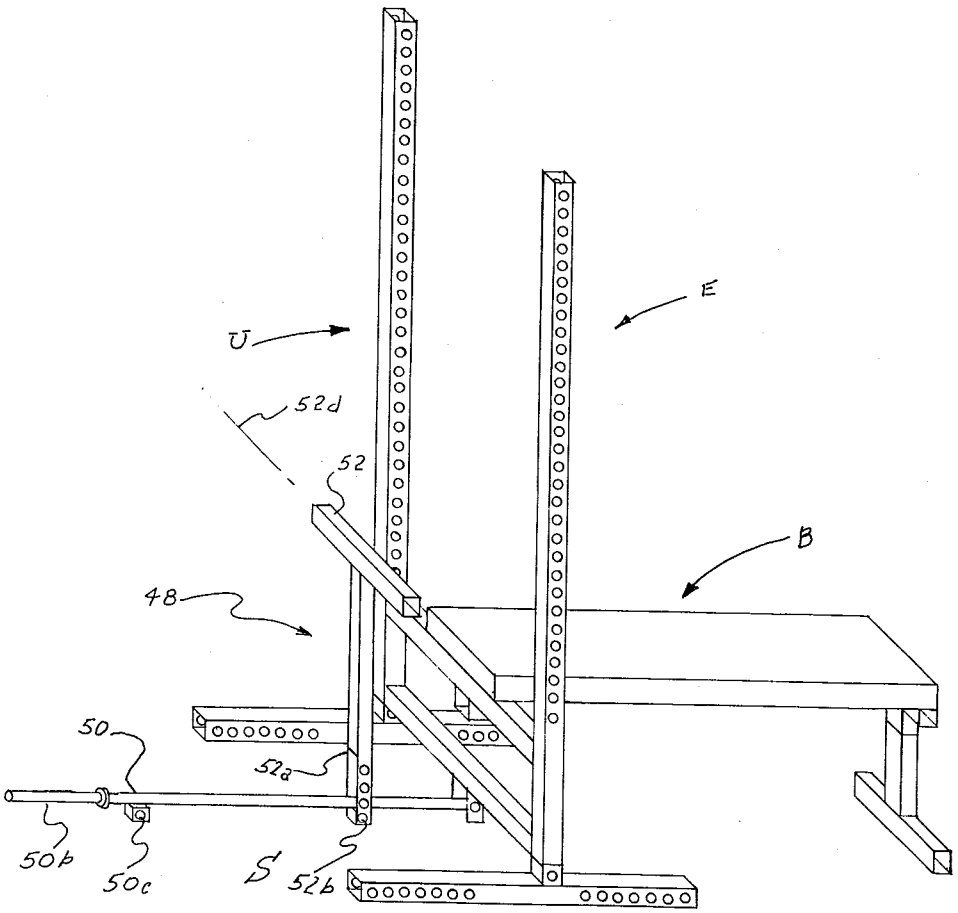
FIG. 16 is a perspective view of the multi-purpose exercise enhancing device assembled for performance of seated calf exercises.

Multi-purpose exercise enhancing device E can be assembled in yet another embodiment for the performance of seated calf exercises (FIG. 16). This embodiment is assembled using upright support section U and bench assembly B and seated calf assembly 48. Seated calf assembly 48 includes weight support means 50 pivotally connected to horizontal member 10 of upright support section U between downwardly extending ears 10*a* having pin receiving opening 10*b*. The horizontal thigh engaging cross bar means 52 is provided with a downwardly extending central vertical member 52*a* pivotally connected at its lower end to the weight support means 50 by pivotal connection at 52*b* to enable lifting of preselected amounts of exercise weights placed on support means 50. The thigh engaging means 52 is disposed or oriented such that the user sits on bench assembly B extending his legs between vertical support members 2 and 4 of upright support section U. The user positions his body straddling vertical member 52*a* so that his upper thighs are generally parallel to the ground or support surface S and his lower legs are perpendicular to the ground while his knees engage the thigh engaging means 52. The user performs seated calf exercises by alternately elevating his heels above the ball of the foot returning his feet to a flat-footed position on the ground S.

In the embodiment of FIG. 1, configured to enhance chinning exercises, the upright support section U mounts first and second universal connecting means 36 and 38, previously discussed, which cooperate to hold chinning bar 50 which also serves as the weight support means 50 in the embodiment of FIG. 16. It is to be understood that those skilled in the art will understand the plural use of the same. Chinning bar 50 has first and second releasable connection means 50*c* and 50*d*, respectively which allow detachable mounting to universal connecting means 36 and 38, respectively. Universal connecting means 36 and 38 may be raised and lowered to a predetermined height and cooperate to maintain chinning bar 50 in a horizontal position relative to the ground or support surface S. Upon assembling the exercise enhancing device E in the embodiment for chins or pullups, the user grasps the chinning bar with both hands and performs chinning-type or pullup-type exercises.

Figure 2:
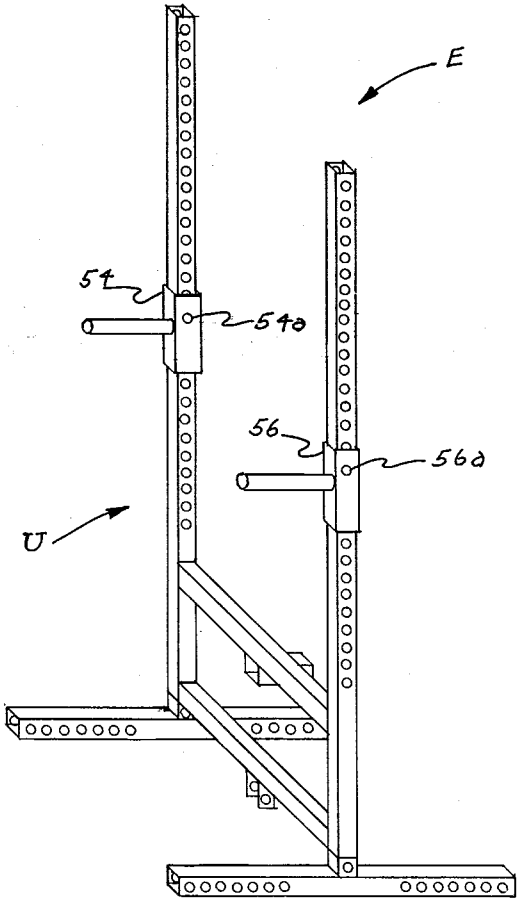
FIG. 2 is a perspective view of the multi-purose exercise enhancing device assembled for performance of dipping exercises.

The device E may be configured in the embodiments as illustrated in FIG. 2 for the performance of dipping-type exercises commonly known as "dips." Upright support section U is used in combination with first and second dipping bars 54 and 56 that are slidably and adjustably mounted to vertical support members 2 and 4, respectively. Dipping bars 54 and 56 have aligned openings 54*a* and 56*a*, respectively, which cooperate with aligned openings 2*a* and 4*a* on vertical members 2 and 4, respectively, through which height adjustment pins 26 engage to maintain dipping bars 54 and 56 at a predetermined height in a fashion previously discussed for use in dipping-type exercises by the user. The user may approach upright support section U either facing toward or facing away from upright support section U to grasp dipping bars 54 and 56.

Figure 3:
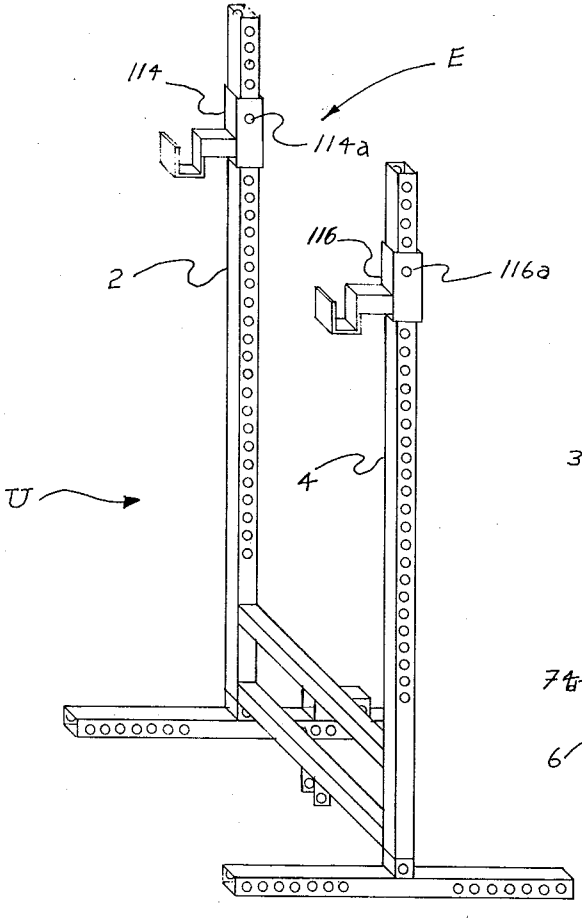
FIG. 3 is a perspective view of the multi-purpose exercise enhancing device assembled for performance of deep knee bend or squat type exercises.

The multi-purpose exercise enhancing device E may be used as a squat rack as the embodiment illustrated in FIG. 3. The upright support section U is used in combination with extended barbell support means 114 and 116 which are slidably and adjustably mounted to vertical support members 2 and 4, respectively. Extended barbell support means 114 and 116 have aligned openings 114*a* and 116*a* which cooperate with aligned openings 2*a* and 4*a* of vertical support members 2 and 4, respectively, in a manner previously discussed. Barbell support means 20 and 22 are adjusted at a height to cooperate in holding a set of barbells (not shown) such that the user faces away from upright support section U, places the barbells (not shown) on his shoulders to remove them from barbell support means 20 and 22 for the performance of squat-type exercises with the barbells.

Figure 7:
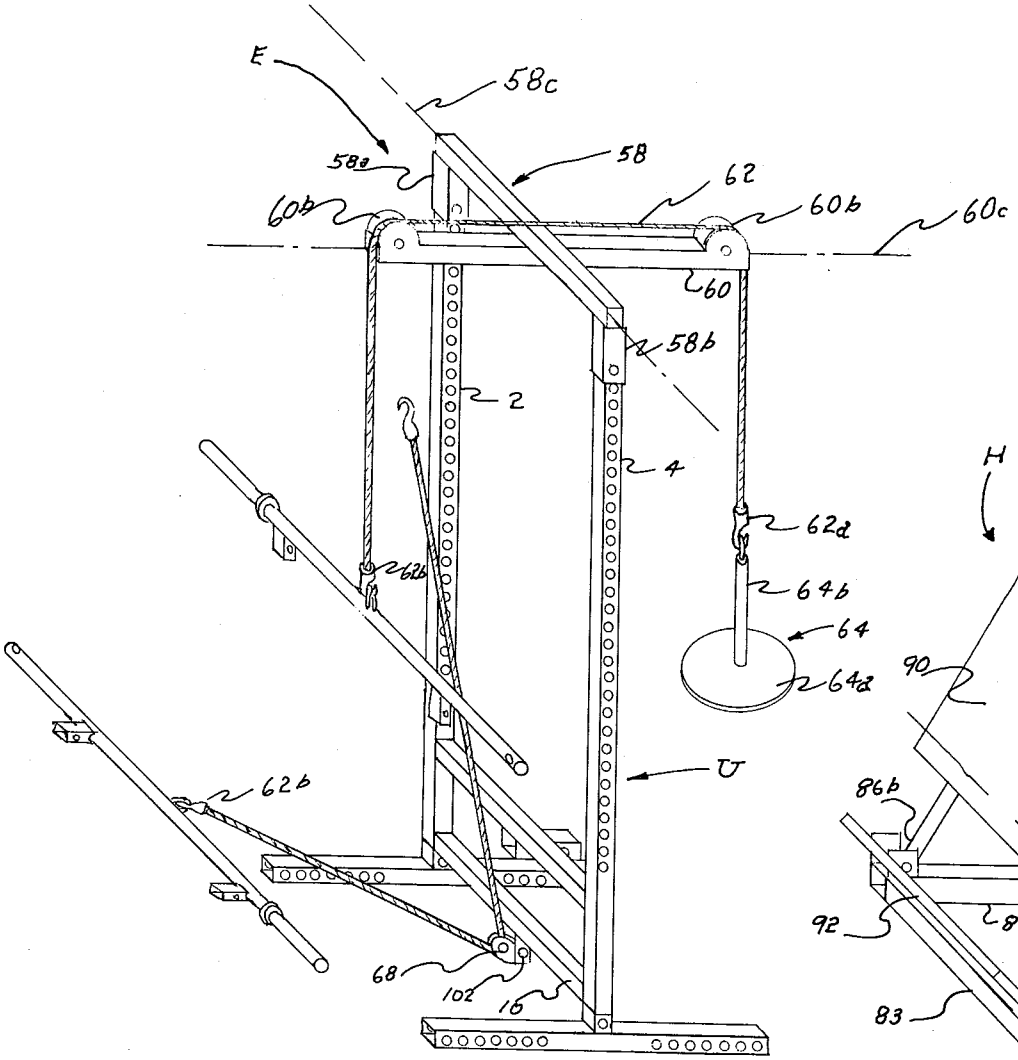
FIG. 7 is a perspective view of the multi-purpose exercise enhancing device assembled for performance of overhead/horizontal lat pull exercises.

The exercise enhancing device E may be assembled in the embodiment shown in FIG. 7 for the performance of overhead lat pull exercises. A third connecting member 58 is releasably attached to vertical support members 2 and 4 by releasable connecting means 58*a* and 58*b* respectively. A cable support pulley means 60 is centrally mounted with the third connecting member 58 at right angles to operably support cable 62. Aligned pulleys 60*a* and 60*b* mounted on the support 60 operably support cable 62 which is releasably connected to exercise weight mounting means 64 having platform portion 64*a* and spindle portion 64*b* by hook 62*a*. The other end of cable 62 mounts a handle 50 for gripping by the user. A predetermined magnitude of barbell-type weights (not shown) may be stacked on spindle 64*b*. The user performs overhead lat pull exercises by grasping handle 50 and pulling the handle 50 to a position behind the user's neck. The user may be standing or sitting while performing overhead lat pull exercises; the objective of this exercise is to lift the predetermined magnitude of exercise weight by pulling downward on handle 50.

Yet another embodiment of multi-purpose exercise enhancing device E for use in lat pull-type exercises is illustrated in FIG. 7. In addition to the elements used in the embodiment just described, lower pulley means 68 is releasably connected to first horizontal member 10 by connection means 10*a*. Cable 62 is operably supported by pulleys 60*a* and 60*b* of cable support pulley means 60 and, further, extends through lower pulley means 68. The multi-purpose exercise enhancing device E of this embodiment allows the user to move a predetermined magnitude of weight mounted on weight mounting means 64 by pulling upwardly on handle 50 while performing standing lat pull or curl-type exercises.

Figure 9:
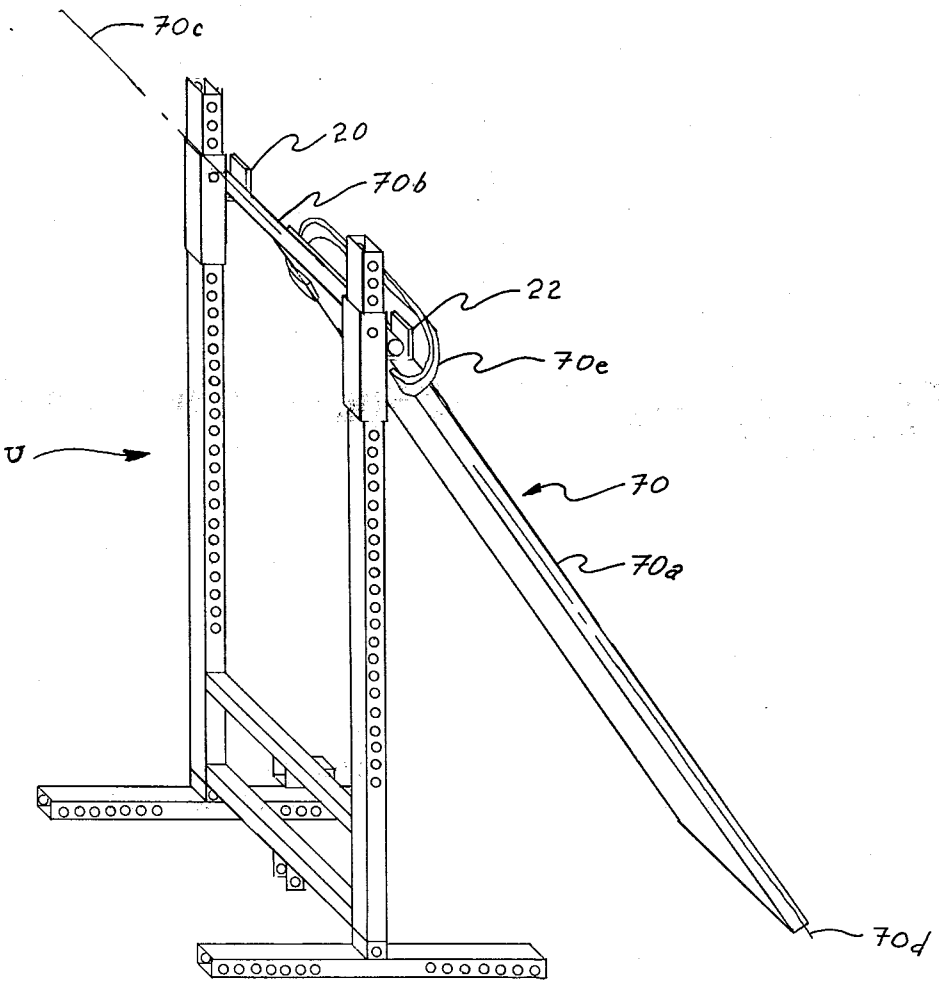
FIG. 9 is a perspective view of the multi-purpose exercise enhancing device assembled for inclined sit up exercises.

The exercise enhancing device E may be configured in the embodiment as seen in FIG. 9 for performance of inclined situps using upright support section U in combination with barbell support means 20 and 22, as previously described, and exercise panel 70. Exercise panel 70 has a planar surface 70*a* which may be padded for user comfort. A support bar 70*b* is attached to one end of exercise panel 70 for securing with the support section U. Foot strap 70*e* is located at the elevated end of panel 70 to secure the feet of the user. Barbell support means 20 and 22 are adjustable in height, as previously discussed, and cooperate to hold support bar 70*b* thus controlling the incline of exercise panel 70.

Figure 15:
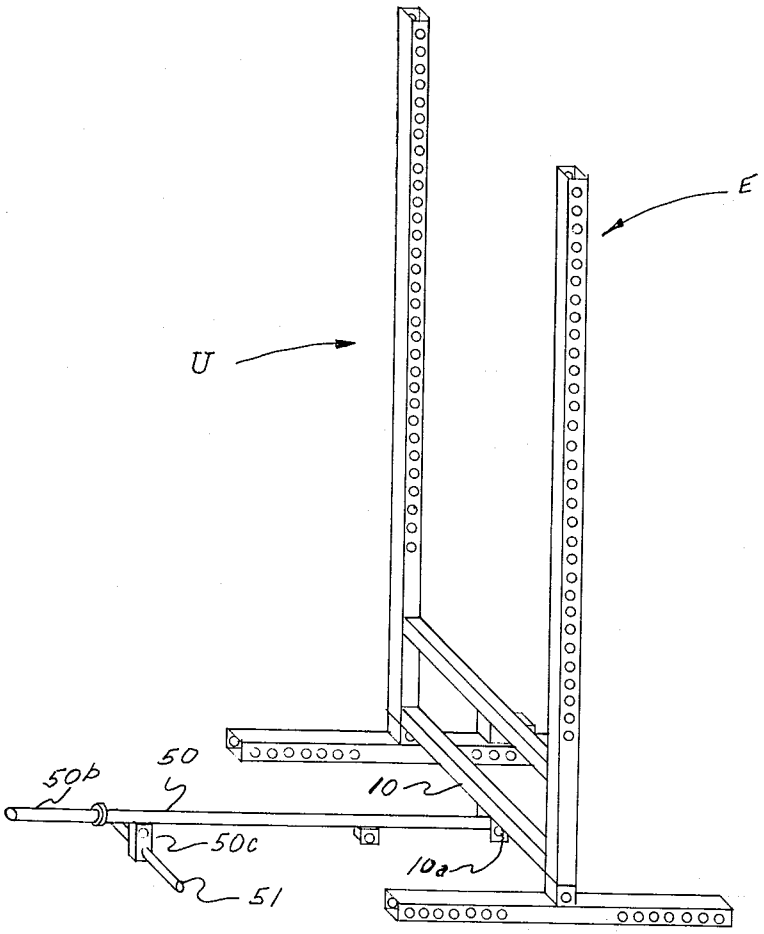
FIG. 15 is a perspective view of the multi-purpose exercise enhancing device assembled for performance of lat row exercises.

Device E can be assembled for use in lat row exercises as illustrated in FIG. 15 using upright support section U in combination with weight support means 50, previously disclosed in conjunction with the seated calf exercise of FIG. 16. Handle member 51 is releasably connected to weight support means 50 by releasable connection means 50*c*. As the user straddles weight support means 50 with his back toward upright support section U, he bends over to grasp handle member 51 and lifts the predetermined magnitude of weight (not shown) mounted on weight mounting portion 50*b* in the performance of lat row-type exercises.

Figure 4:
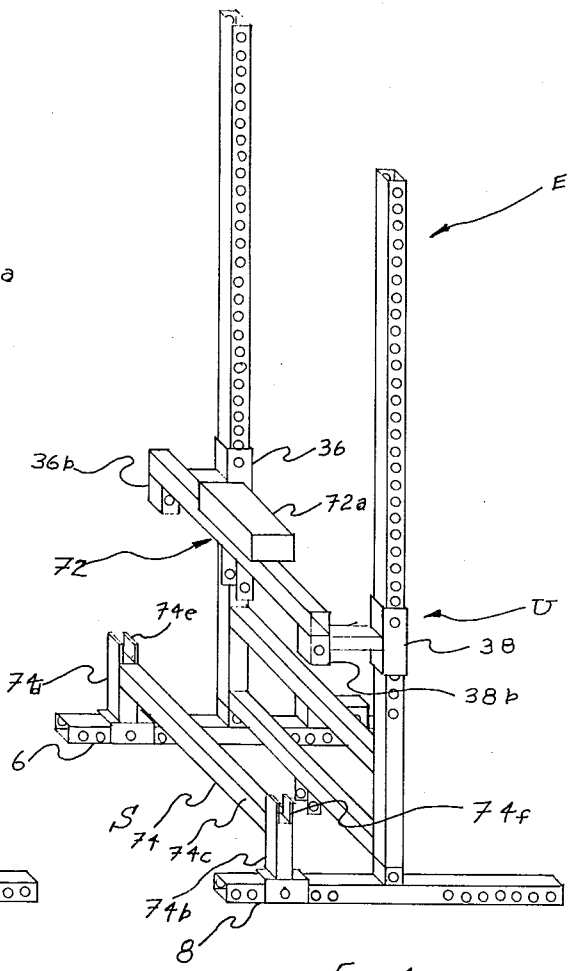
FIG. 4 is a perspective view of the multi-purpose exercise enhancing device assembled for performance of arched back type sit ups.

FIG. 4 illustrates the exercise enhancing device E assembled in an embodiment for use as a roman chair exercise enhancer. Upright support section U and universal connecting means 36 and 38 mount a horizontal body support member 72 which includes seat portion 72*a* which may be padded for comfort. The height of horizontal body support member 72 may be varied or adjusted by raising and lowering universal connecting means 36 and 38 in a manner previously described. To perform arched back situps the user sits on seat portion 72*a* facing away from upright support section U and by lowering his upper body down to the ground and then returning to the sitting position.

To aid in this exercise horizontal foot retaining member 74 is slidably and adjustably mounted on base members 6 and 8. Horizontal foot retaining member 74 has a horizontal foot engaging portion 74*c* which is supported a predetermined height from the ground or support surface S by first and second weight support means 74*a* and 74*b* mounted on base members 6 and 8, respectively, Weight support means 74*a* and 74*b* have first and second weight support portion 74*e* and 74*f*, respectively, which may also be used to support a set of barbells (not shown) when desired. As the user sits on seat portion 72*a* of horizontal body support member 72 facing away from upright support section U, he engages his feet under horizontal foot retaining member 74. He then leans backward between vertical support members 2 and 4, arching his back and touching the ground with his shoulders in the performance of arched back situp-type exercises. Foot retaining member 74 allows the user maintain his balance while returning to the upright sitting position.

Figure 5:
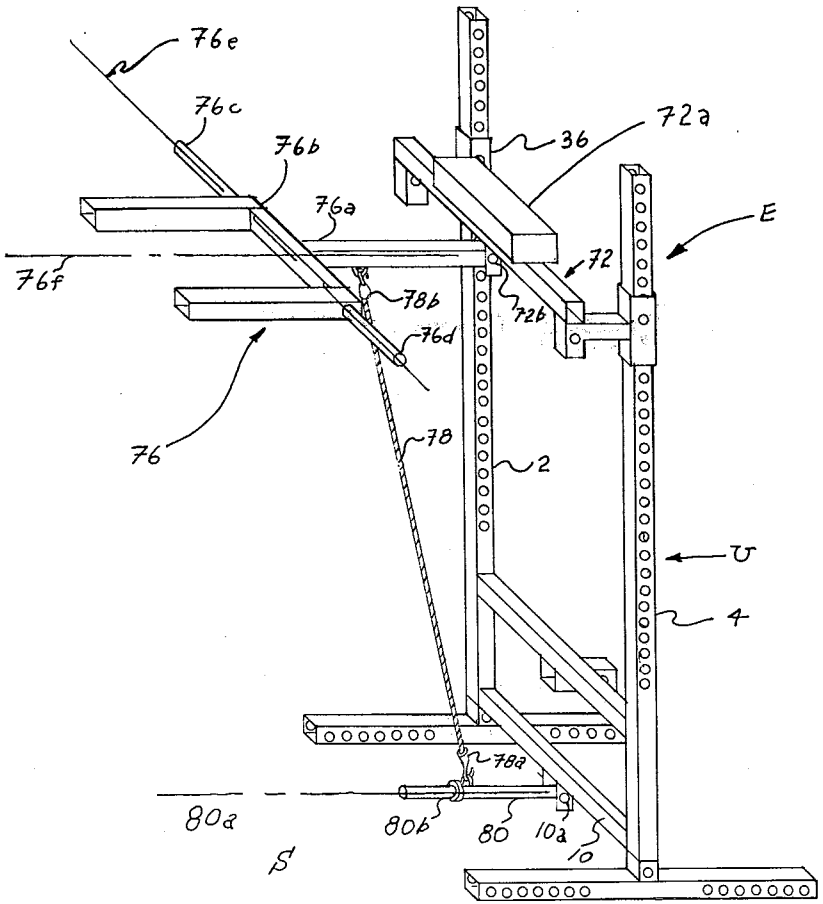
FIG. 5 is a perspective view of the multi-purpose exercise enhancing device assembled for performance of standing calf exercises.

Multi-purpose exercise enhancing device E may be further assembled in the embodiment illustrated in FIG. 5 for performing standing calf exercises. The upright support section U is used with body support member 72, a shoulder yoke 76, a cable 78 and a weight mounting means 80. The first and second universal connecting means 36 and 38 are mounted to vertical support members 2 and 4 to hold horizontal body support member 72 which may be adjusted to a predetermined height. The shoulder yoke 76 has a main arm portion 76*a* pivotally connected to horizontal body support member 72 at pivotal connecting means 72*b* and a U-shaped portion 76*b* which is connected to main arm portion 76*a* such that a yoke is formed with the opening of the U facing away from upright support section U. First and second handles 76*c* and 76*d* are mounted, with the yoke 76 such that handles 76*c* and 76*d* lie on the same longitudinal axis 76*e*. Weight mounting means 80 is pivotally connected to first horizontal member 10 by pivotal connection means 10*a* in a manner previously described with respect to FIGS. 15 and 16. The weight mounting portion 80*b* of weight mounting means 80 is adapted to receive a predetermined magnitude of barbell type weights in the usual manner while cable 78 is releasably connected to weight mounting means 80 at one end by hook 78*a*. The other end of cable 78 is releasably connected to main arm portion 76*a* of shoulder yoke 76 by hook 78*b*. The user orients his body facing away from upright support section U and engaging the U-shaped portion 76*b* on his shoulders and grasps first and second handles 76*c* and 76*d*. The user performs standing calf exercises by alternately raising his body on his toes by elevating his heels and then returning his feet to a flat footed position on the ground or support surface S.

Figure 6:
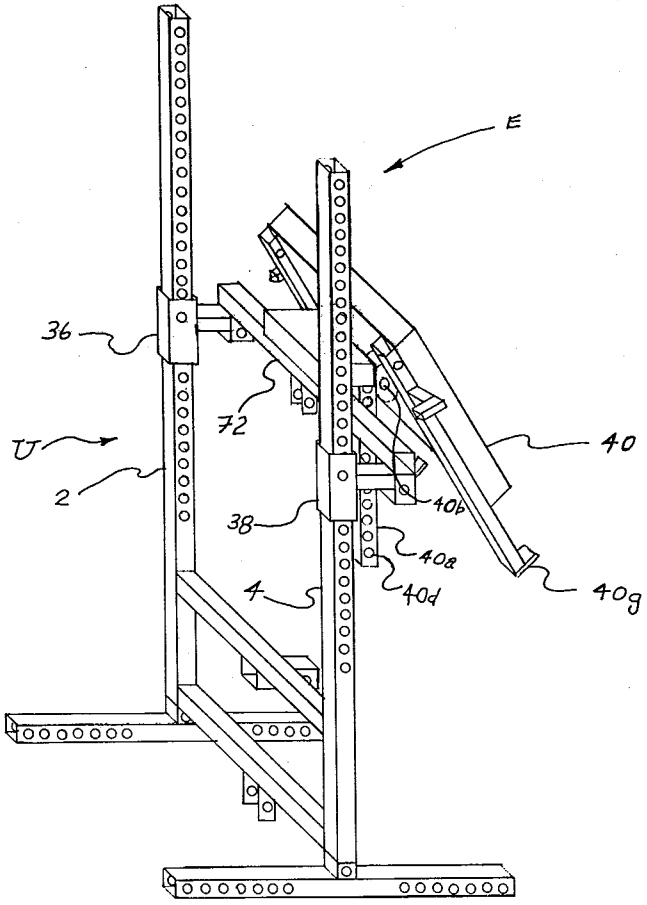
FIG. 6 is a perspective view of the multi-purpose exercise enhancing device assembled for performance of standing biceps exercises.

Device E may be configured as the embodiment illustrated in FIG. 6 to perform standing bicep exercises using upright support section U, previously described, in combination with universal connecting means 36 and 38, horizontal body support member 72 and user partial rest platform 40. First and second universal connecting means 36 and 38 are adjustably and slidably mounted to vertical support members 2 and 4 and horizontal body support member 72 is releasably attached thereto as previously described. As also previously disclosed, user partial rest platform 40 may be pivoted about point 40*b* to provide the proper angle 40*h* to comfortably support the biceps of a user as he stands. The user faces upright support section U placing one or both arms between vertical support members 2 and 4 and resting his triceps on user partial rest platform 40 for the performance of standing bicep-type exercises.

Figure 8:
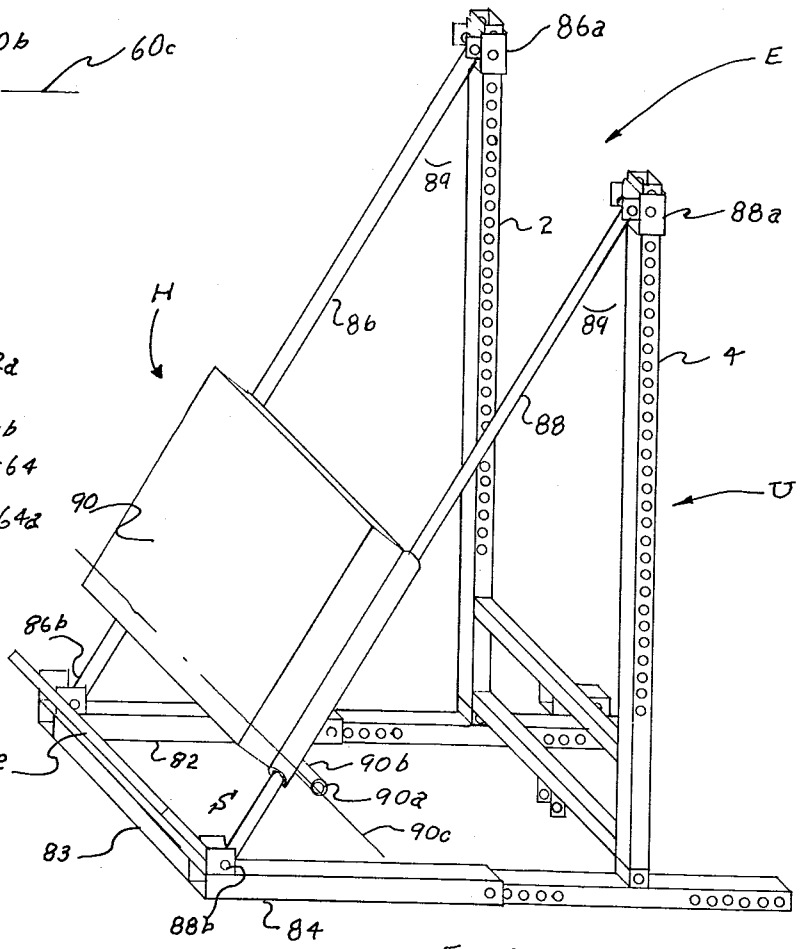
FIG. 8 is a perspective view of the multi-purpose exercise enhancing device assembled for performance of hack leg or squat type exercises.

Multi-purpose exercise enhancing device E may be assembled to conform to the embodiment illustrated in FIG. 8 for the performance of hack leg exercises using upright support section U in combination with hack leg section, generally designated by the letter H. Hack leg section H includes first and second user back support base members 82 and 84 which slide concentrically over base members 6 and 8, respectively, to serve as extensions which are connected by a lateral connecting member 83. First and second back support frame guide members 86 and 88 connect user back support base members 82 and 84 to vertical support members 2 and 4, respectively on a common inclined plane. The back support frame member 86 is releasably connected to vertical support member 2 at 86*a* and, further, releasably connected to user back support base member 82 by releasable connecting means 86*b*. User back support frame member 88 is releasably connected at one end to vertical support member 4 at 88*a* and at the opposite end to user back support base member 84 at 88*b*. User back support frame members 86 and 88 are inclined from vertical support members 2 and 4, respectively, at adjustable angle 89 forming an incline guide means for user support panel 90. A user support panel 90 is slidably mounted on the user back support frame members 86 and 88 for guided movement along the inclined plane formed by members 86 and 88. Handle means 90*a* for the user is attached across the lower portion of user support panel 90 on 9 longitudinal axis 90*c* which remains parallel to the ground S. A portion 90*b* of the handle 90*a* serves as a weight mounting means for a predetermined magnitude barbell type weights (not shown) to be mounted thereon. A foot rest 92 may be mounted adjacent lateral connecting member 83 by releasable connecting means 86*b* and 88*b*. The plane of inclined foot rest 92 is perpendicular to the plane of user support panel 90 on tracks 86 and 88 to provide a platform on which the user may stand while performing hack leg or deep knee bend-type exercises. To perform those exercises the user rests lower portion of his back on user support panel 90 while placing his feet shoulder width apart on inclined foot rest 92. Then grasping handle means 90*a*, the user moves from an initial squat type position to a full standing position and returns to the squat position. The user repeats this exercise a prescribed number of times for the predetermined weight in the performance of hack leg or deep knee bend type exercises.

Figure 17:
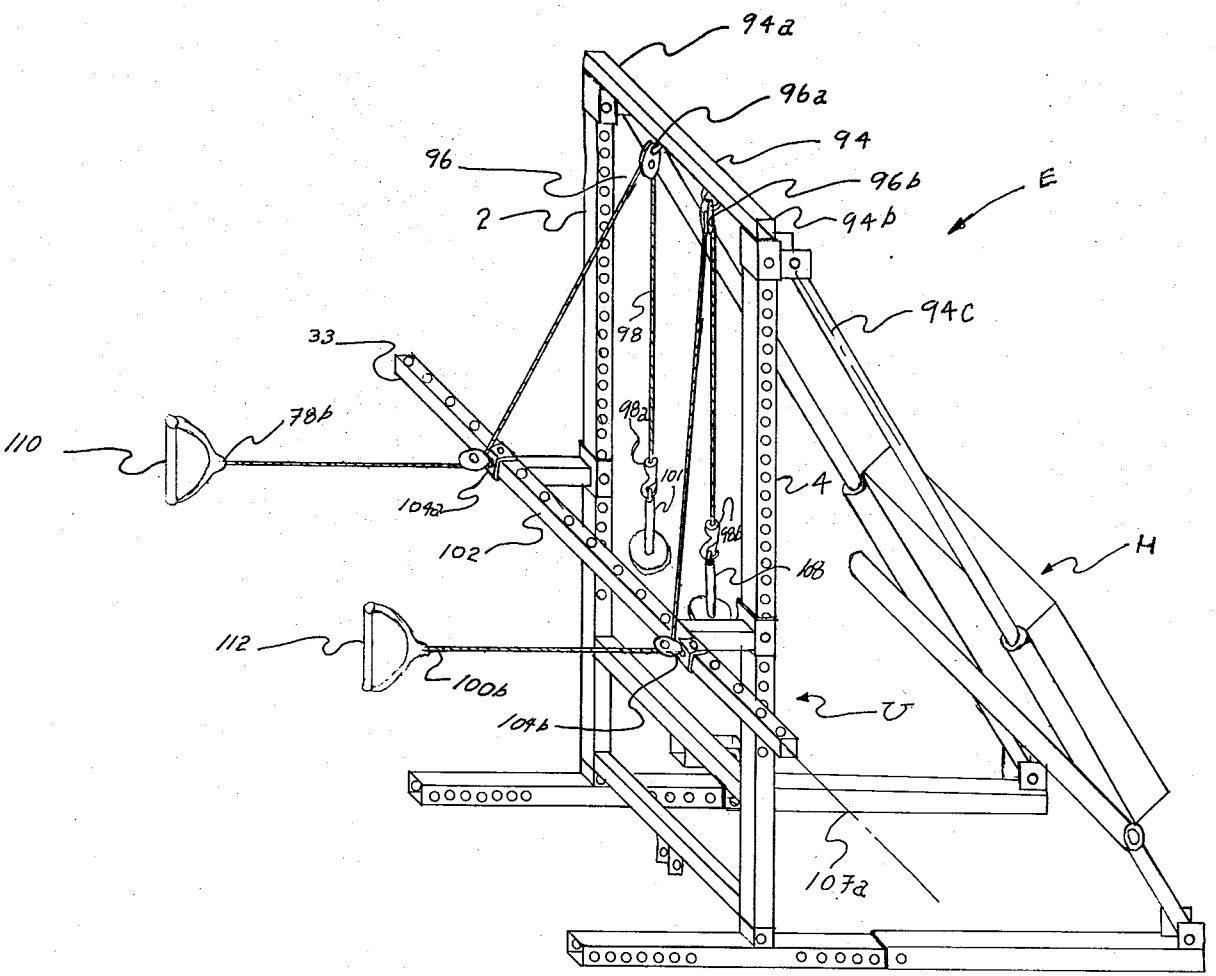
FIG. 17 is a perspective view of the multi-purpose exercise enhancing device assembled for performance of cable pull exercises.

Multi-purpose exercise enhancing device E may be assembled as seen in FIG. 17 for use in cable pull-type exercises. Upright support section U is used in combination with hack leg section H as previously described. The multi-purpose exercise enhancing device E of this embodiment further includes a third horizontal member 94 attached to vertical support member 2 by releasable connecting means 94*a* and attached to vertical support member 4 by releasable connecting means 94*b* in a manner previously described. A fourth horizontal member 102 is slidably and adjustably mounted to vertical support members 2 and 4 parallel to member 94 in a fashion similar to universal connecting means 36 and 38, previously described. Mounted on member 94 are cable support pulley means 96 which includes pulleys 96*a* and 96*b* for operably supporting exercise cables 98 and 100, respectively, while a lower cable support pulley means 104 includes pulleys 104*a* and 104*b* mounted on horizontal member 102. The exercise cable 98 is operably supported by pulley 96*a* and 104*a*, and likewise exercise cable 100 is operably supported by pulleys 96*b* and 104*b*. Exercise cable 98 is releasably attached at one end to weight mounting means 106 having a platform portion 106*a* and spindle portion 106*b* by releasable connecting means 98*a* and at the other end to handle 110 at 98*b*. Predetermining amounts of conventional barbell type weights (not shown) may be placed on the spindle 106*b* in the usual manner. Exercise cable 100 is operably supported by pulleys 96*b* and 104*b* in a similar manner with weight mounting means 108 at one end and handle 112 at the other end. A user may face upright support section U alternately pulling on handles 110 and 112 to raise the weights on weight mounting means 106 and 108, respectively. Alternatively, the user may face away from upright support section U and raise weight mounting means 106 and 108 by extending his arms alternately thereby pushing handles 110 and 112 to perform yet another variation of cable pull-type exercises.

The multi-purpose exercise enhancing device E and all of its accessories are easily disassembled and stacked for storage in a relatively small volume. Tubular members are lightweight but strong, making the device E and its accessories easily transportable, easily assemblable for the various exercises.

The foregoing disclosure and description of the invention are illustrative and explanatory thereof in various changes in the size, shape and materials as well as in the details of the illustrated construction may be made without departing from the spirit of the invention.

I claim:

1. A multi-purpose exercise enhancing apparatus which is easily assembled for free standing use on a horizontal support surface and which apparatus may be readily disassembled for storage and ease of transportation, said apparatus comprising:

first and second base members;

first and second vertical support members extending vertically upward from first and second base members, said first first vertical support member extending upwardly from said base member and said second vertical support member extending upwardly from said second base member;

said first and second base members spaced apart a predetermined distance for stabilizing and maintaining said first and said second vertical support members for use in a free standing vertical relationship to a substantially horizontal support surface;

means for releasably connecting said respective base members and said vertical support members to enable disassembly of the exercise enhancing device when desired for storage, ease of transportation, and the like;

a first horizontal member having one end secured with said first vertical support member and the other end secured with said second vertical support member;

a second horizontal member having one end secured with said first vertical support member and the other end secured with said second vertical support member, said second horizontal member disposed a preselected distance from said first and second base members, said first horizontal member located between said second horizontal member and said first and second base members;

said first and second vertical support members when operably connected with said first and second base members forming a stable, self-supporting frame on the horizontal surface for the exercise apparatus;

first and second user back support base members, said first user back support base member connected with said first base member and said second user back support base member connected with said second base member;

first and second user back support frame members, said first user back support frame member connected at a first end to said first vertical support member and at a second end to said first user back support base member, and said second user back support frame member connected at a first end with said second vertical support member and at a second end with said second user back support base member, said first and second user back support frame members forming an inclined guide means which guides a user supporting panel;

a user support panel mounted on said first and second back support frame members for movement on said guide means;

handle means mounted with said back support panel for gripping by a user while performing inclined deep knee bend-type exercises with a portion of the user's weight supported by said back support panel wherein a self-supporting exercise apparatus for use on a horizontal support surface that may be easily disassembled is provided;

a third horizontal member for releasable attachment at a first end with said first vertical support member and for releasable attachment at a second end with said second vertical support member;

first and second cables;

a first cable support pulley means mounted with said third horizontal member for operably supporting said first cable;

a second cable support pulley means mounted with said third horizontal member for operably supporting said second cable, each of said first and second cables having first and second ends and operably supported by said first and second cable support pulley means;

first and second means for holding a preselected magnitude of exercise weights said first weight holding means secured with said first end of said first cable and said second weight holding means secured with said first end of said second cable; and first and second handles for holding by user, said first handle being secured to said second end of said first cable and said second handle being secured to said second end of said second cable for lifting the exercise weights independently of one another by pulling on said handles to perform cable pull exercises.

* * * * *